US007240770B2

(12) United States Patent
Mullins et al.

(10) Patent No.: US 7,240,770 B2
(45) Date of Patent: Jul. 10, 2007

(54) ROOF ANCHOR

(75) Inventors: Douglas Wayne Mullins, Troutville, VA (US); Douglas Scott Mullins, Troutville, VA (US)

(73) Assignee: Construction Specialty Anchors LLC, Troutville, VA (US)

( * ) Notice: Subject to any disclaimer, the term of this patent is extended or adjusted under 35 U.S.C. 154(b) by 431 days.

(21) Appl. No.: 10/983,718

(22) Filed: Nov. 9, 2004

(65) Prior Publication Data

US 2006/0096238 A1 May 11, 2006

(51) Int. Cl.
*A62B 1/00* (2006.01)

(52) U.S. Cl. ..... 182/3; 52/24; 52/25; 52/26; 248/214; 248/300; 182/45

(58) Field of Classification Search ..... 52/24–26; 248/214, 226.11, 228.1, 228.5; 24/569; 269/243, 269/270

See application file for complete search history.

(56) References Cited

U.S. PATENT DOCUMENTS

| | | | | |
|---|---|---|---|---|
| 1,330,309 | A | 2/1920 | Dixon | |
| 4,334,662 | A * | 6/1982 | Davis et al. | 248/237 |
| 4,606,430 | A * | 8/1986 | Roby et al. | 182/3 |
| 5,222,340 | A * | 6/1993 | Bellem | 52/463 |
| 5,694,720 | A | 12/1997 | Walcher et al. | |
| 5,711,397 | A * | 1/1998 | Flora et al. | 182/3 |
| 5,732,513 | A | 3/1998 | Alley | |
| 5,758,743 | A | 6/1998 | Coyle et al. | |
| 6,164,033 | A | 12/2000 | Haddock | |
| 6,604,403 | B1 * | 8/2003 | Eslambolchi et al. | 72/416 |
| 6,718,718 | B2 * | 4/2004 | Haddock | 52/545 |
| 2003/0066247 | A1 | 4/2003 | Trevorrow | |

FOREIGN PATENT DOCUMENTS

| | | |
|---|---|---|
| WO | 9949154 | 9/1999 |

* cited by examiner

*Primary Examiner*—Jeanette Chapman
*Assistant Examiner*—Dan Kenny
(74) *Attorney, Agent, or Firm*—Kenyon & Kenyon LLP

(57) ABSTRACT

A roof anchor including a pair of blocks positioned side-by-side. The blocks have adjacent, inner surfaces with notches cut therefrom for receiving a standing seam of a metal roof. The blocks also have outer surfaces remote from the inner surfaces. A bracket is positioned over the pair of blocks. The bracket includes a base portion having a pair of legs, each being positioned adjacent a respective one of the outer surfaces of the blocks, and a crosspiece, positioned adjacent the tops of the blocks, joining the legs together. A loop portion is affixed to the base portion for securement of a workman's safety lanyard. A threaded fastener penetrates the pair of blocks and the pair of legs for: fastening the pair of blocks together, securing the bracket to the pair of blocks, and clamping the pair of blocks upon a standing seam of a metal roof.

5 Claims, 2 Drawing Sheets

ROOF ANCHOR

FIELD OF THE INVENTION

The present invention relates to static structures and, more particularly, to assembled in situ-type anchors or ties.

BACKGROUND OF THE INVENTION

Roofing has always been a particularly difficult avocation. Putting up roofs not only requires the lifting of heavy tools and materials, but also necessitates that this be done high above the ground and during the heat of the day. The problems are compounded when the pitch of a roof is steep or the roofing materials are slick. The possibility of a life-threatening slip and fall is ever present.

To lessen the risk of injury, roofers have proposed guard rails and tethering devices for attachment to roofs and other stable portions of buildings. Unfortunately, these things have been complex in their construction and difficult to install, particularly on standing seam roofs formed of interlocking metal sheets that have few convenient mounting places. Thus, they have seen little use outside of areas where they are mandated by law.

SUMMARY OF THE INVENTION

In light of the problems associated with the known safety devices for preventing slips and falls from roofs, it is a principal object of the invention to provide a roof anchor of uncomplicated construction that can be easily mounted on all known types of standing seam roofs. The roof anchor can be secured to a standing seam located anywhere upon the roof in a matter of seconds. The anchor can be repositioned as many times as desired so that a roofer need never work too far from an anchor to make it inaccessible.

It is a further object of the invention to provide a roof anchor of the type described that will not harm a standing seam roof during typical use. The anchor is non-marring.

It is another object of the invention to provide a roof anchor of the type described that is intuitive to use and that can be installed by unskilled laborers with wrenches found in a typical toolbox after only a few minutes of instruction.

It is an object of the invention to provide improved elements and arrangements thereof in a roof anchor for the purposes described which is lightweight in construction, inexpensive to manufacture, and dependable in use by one or more roofers at a time.

Briefly, the roof anchor in accordance with this invention achieves the intended objects by featuring a pair of blocks positioned side-by-side. Each of the blocks has an inner surface defined by a top flange and a bottom flange separated by a triangular notch that receives a standing seam of a metal roof. A bracket is positioned over the blocks. The bracket includes a base portion, having a pair of legs joined by a crosspiece, and a loop portion affixed to the crosspiece for securement of a workman's safety lanyard. A number of threaded fasteners penetrate the blocks above their bottom flanges for fastening the blocks together and clamping the bottom flanges against opposite sides of a standing seam of a metal roof. One of the threaded fasteners penetrates the pair of legs for securing the bracket to the blocks. Each of a pair of alignment pins has opposed ends extending through the notches and penetrating the blocks above their bottom flanges.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
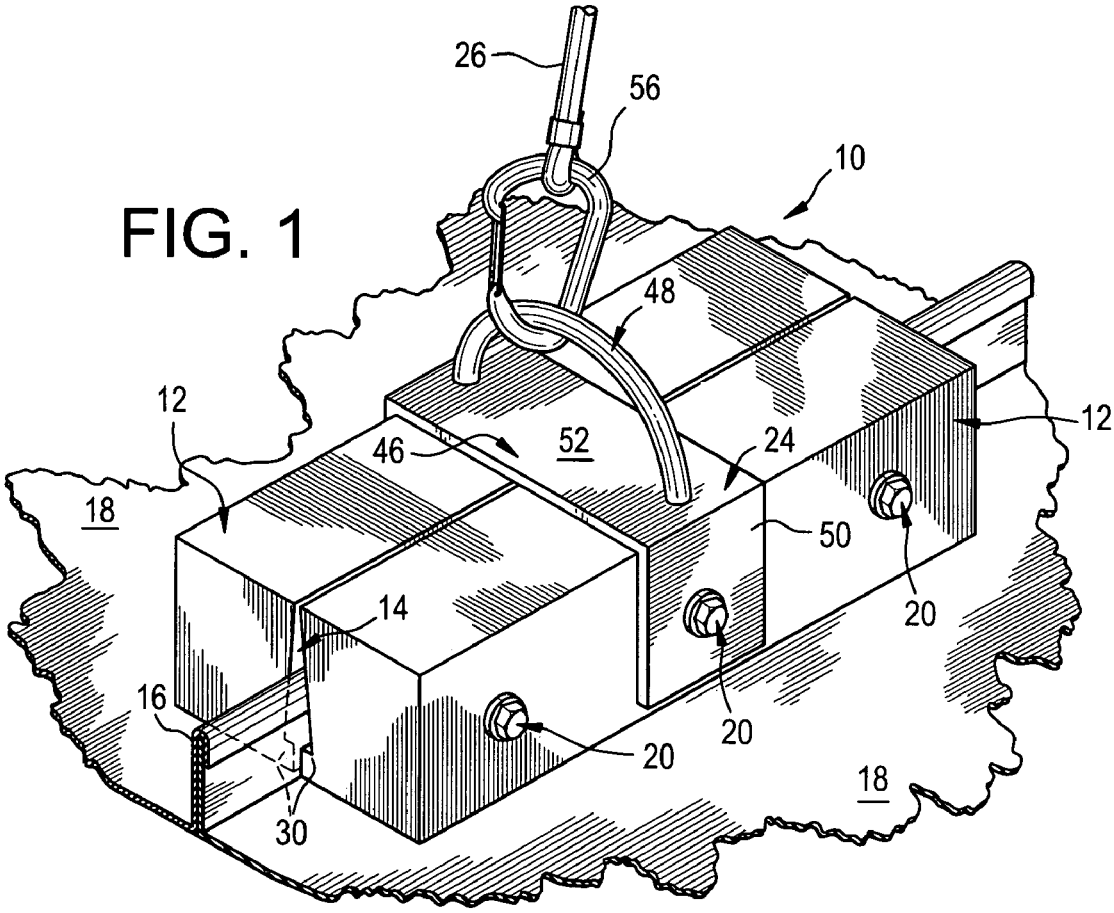
FIG. 1 is a perspective view of a roof anchor in accordance with the present invention.
Figure 2:
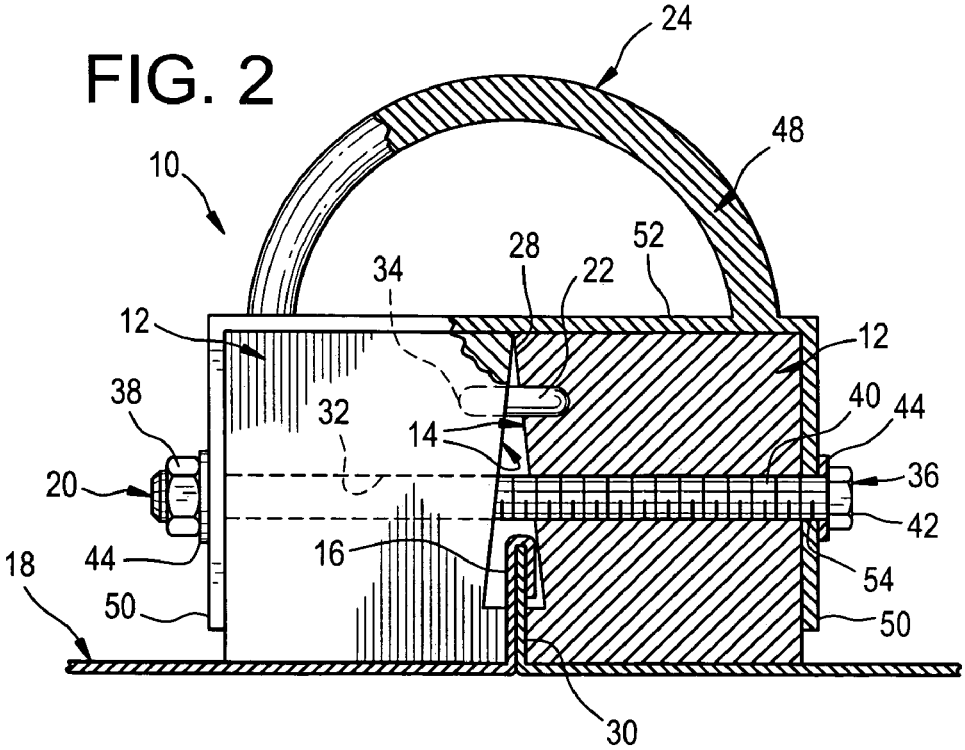
FIG. 2 is a side view of the roof anchor of FIG. 1 with portions broken away to reveal details thereof.
Figure 3:
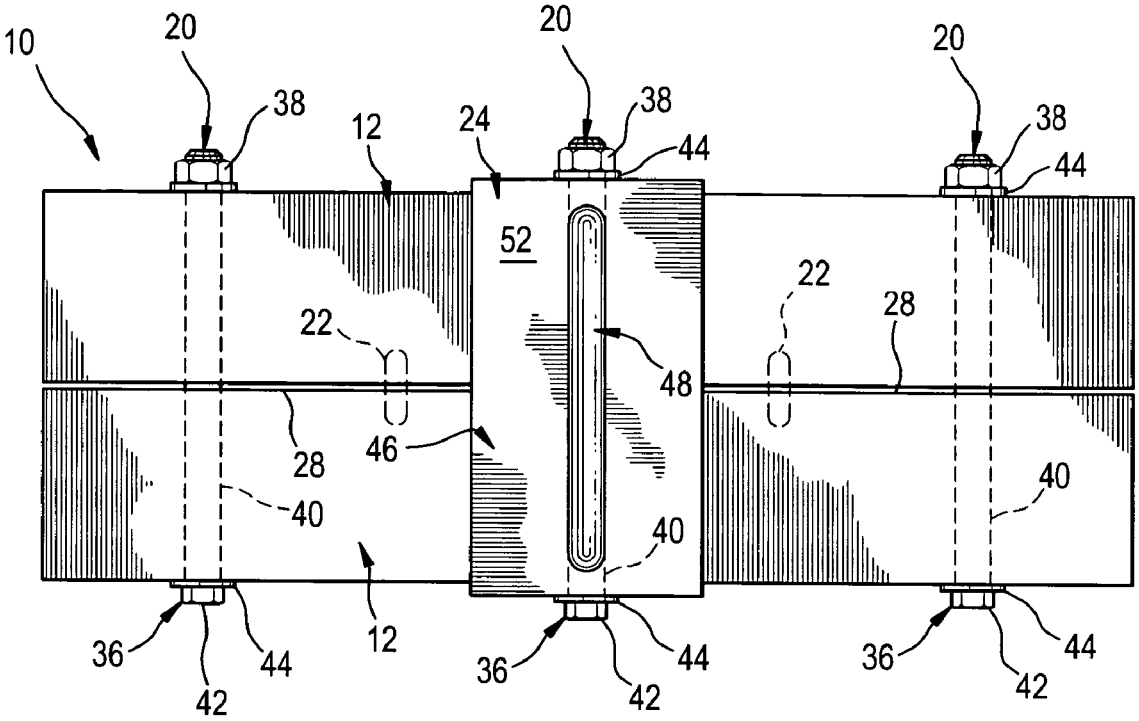
FIG. 3 is a top view of the roof anchor.
Figure 4:
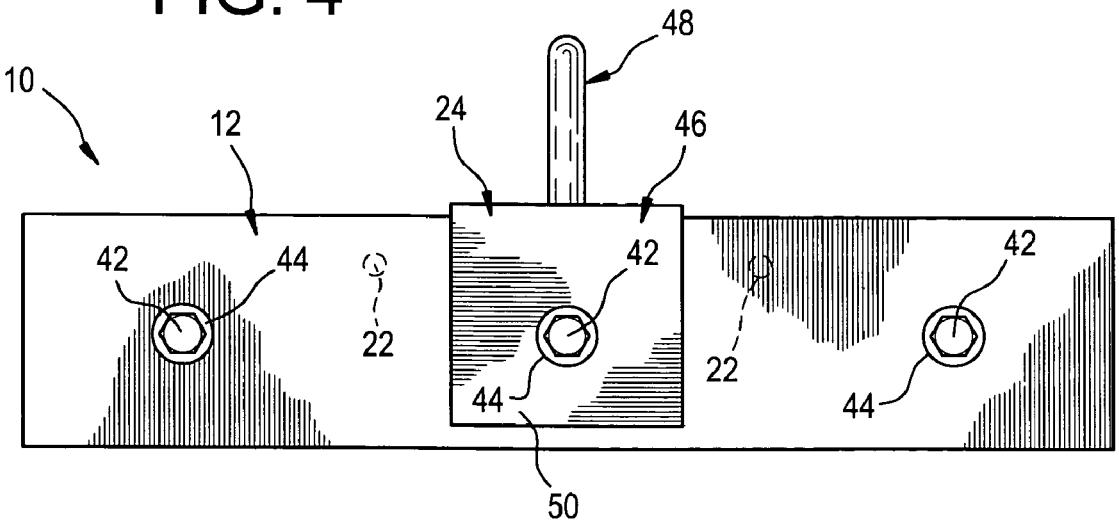
FIG. 4 is a front view of the roof anchor.

Referring now to the FIGS., a roof anchor in accordance with the present invention is shown at 10. Anchor 10 includes a pair of blocks 12 having notches 14 cut from their inner surfaces to receive a standing seam 16 of a metal roof 18. Blocks 12 are held together, on opposite sides of standing seam 16, by a number of threaded fasteners 20 and alignment pins 22. Blocks 12 are drawn together to securely grasp standing seam 16 when fasteners 20 are tightened. A bracket 24, to which one or more workmen can tie safety lanyards 26 while working atop roof 18, is attached to blocks 12 by one of fasteners 20.

Each of blocks 12 is formed of metal and has an elongated, rectangular shape. In its preferred form, each block 12 has a length of about 12 inches (30 cm), a width of about 2.5 inches (6.4 cm) and a height of about 3 inches (7.6 cm). These dimensions provide blocks 12 with sufficient strength to resist, without breakage, the forces imparted by a falling workman tethered to blocks 12 by lanyard 26.

A notch 14 extends the length of each block 12, from one end thereof to the other. Each notch 14 is mirror image of the other and is triangular in outline, having a width of about 0.25 inches (0.6 cm) at its bottom positioned about 0.5 inches (1.3 cm) above the bottom of a block 12 and tapering to a width of zero at the top of a block 12. Since each notch 14 neither penetrates the bottom nor the top of its associated block 12, each block 12 retains a top flange 28 and a bottom flange 30. During use of anchor 10, top flanges 28 of blocks 12 are brought into engagement with one another by the tightening of fasteners 20 to serve as a fulcrum to drive bottom flanges 30 strongly against the opposite sides of standing seam 16.

Three lateral bores 32 are provided in each block 12 to accommodate fasteners 20. As shown, bores 32 are evenly spaced along the length of each block 12 and are positioned about midway between the top of each block 12 and the bottom thereof. When blocks 12 are positioned side-by-side during their use, bores 32 can be brought into registry with one another to permit the passage of fasteners 20 through notches 14 and above standing seam 16.

A pair of recesses 34 is provided in the top of each block 12 for receiving a pair of alignment pins 22. Each of recesses 34 is circular in outline and penetrates a block 12 to a depth equal to about one-fifth of its width. When blocks 12 are positioned side-by-side, recesses 34 are registered with one another to snugly accept alignment pins 22. Alignment pins 22 being dimensioned so as to be snugly received within recesses 34 are prevented from falling therefrom by the clamping action of fasteners 20.

Each of threaded fasteners 20 comprises a bolt 36 to which a nut 38 is threadably attached. Bolt 36 includes a threaded shaft 40 slidably positioned in a pair of axially aligned bores 32 and a head 42 affixed to one end of the shaft 40 for positioning against the front of one of blocks 12. Washers 44 are positioned between the nut 38, head 42 and blocks 12 to better distribute compressive loads to blocks 12 when fasteners 20 are tightened.

Bracket 24 includes a base portion 46 for attachment to blocks 12 and a loop portion 48 extending upwardly therefrom. Base portion 46 has a pair of upright legs 50 joined by a crosspiece 52 and in a configuration resembling an inverted "U". Each of legs 50 is provided with an aperture 54 for the passage of threaded rod 40 of a fastener 20. Loop portion 48, on the other hand, comprises a rod that has been bent into a shape resembling an inverted "U" and whose opposite ends are secured to opposite ends of crosspiece 52.

Use of roof anchor 10 is straightforward. First, blocks 12 are positioned atop roof 18 on opposite sides of standing seam 16 with alignment pins 22 being captured within axially aligned recesses 34. Then, the base portion 46 of bracket 24 is slid downwardly over blocks 12 and its apertures 54 are axially aligned with a pair (preferably the central pair for load distribution purposes) of lateral bores 32 in blocks 12. Next, the threaded shafts 40 of bolts 36 are extended through all lateral bores 32 and nuts 38 are fastened to the ends of shafts 40 thereby joining blocks 12 to one another and joining bracket 24 to blocks 12. By tightening nuts 38 on bolts 36, flanges 30 grip seam 16 with such force that blocks 12 cannot be moved relative to seam 16 without severely damaging roof 18.

Once roof anchor 10 is in place on a roof 18 a safety lanyard 26, having a typical caribiner 56 at its end for releasably grasping loop portion 48, is attached to bracket 24. A workman (not shown) to which lanyard 26 is attached is now effectively prevented from falling from roof 18. The entire process required to ensure the workman's complete safety requires only a few minutes to complete and will not damage the roof 18 upon which the workman is deployed.

When roof anchor 10 is no longer needed at its original location, fasteners 20 can be untightened somewhat and anchor 10 can either be slid to a new location along seam 16 or carried to another seam 16 without need for disassembly. In fact, after roof anchor 10 is initially assembled, it need not be disassembled again unless a thorough cleaning or an infrequent replacement of worn parts is required. Thus, roof anchor 10 is always ready for use.

While the invention has been described with a high degree of particularity, it will be appreciated by those skilled in the art that modifications may be made thereto. For example, the number and location of threaded fasteners 20 and alignment pins 22 can be increased or decreased to suit the needs of a user. Therefore, it is to be understood that the present invention is not limited to the sole embodiment described above, but encompasses any and all embodiments within the scope of the following claims.

We claim:

1. A roof anchor, comprising:

a pair of blocks positioned side-by-side, said blocks having adjacent, inner surfaces with notches cut therefrom for receiving a standing seam of a metal roof, said blocks also having outer surfaces remote from said inner surfaces;

a bracket positioned over said pair of blocks, said bracket including:

a base portion having a pair of legs, each positioned adjacent a respective one of said outer surfaces, and a crosspiece, positioned adjacent the tops of said blocks, joining said legs; and, a loop portion affixed to said base portion for securement of a safety lanyard;

a threaded fastener penetrating said pair of blocks and said pair of legs for: fastening said pair of blocks together, securing said bracket to said pair of blocks, and clamping said pair of blocks upon a standing seam of a metal roof.

2. The roof anchor according to claim 1 further comprising a pair of alignment pins positioned away from each other and said fastener, each of said alignment pins having opposed ends extending through said notches and penetrating said pair of blocks.

3. A roof anchor, comprising:

a pair of blocks positioned side-by-side, each of said blocks having an inner surface defined by a top flange and a bottom flange separated by a notch for receiving a standing seam of a metal roof, each of said blocks also having an outer surface;

a bracket including:

a base portion having a pair of legs, each positioned adjacent one said outer surface, and a crosspiece, positioned adjacent the tops of said blocks, joining said legs; and, a loop portion affixed to said crosspiece for securement of a safety lanyard; and, a threaded fastener penetrating each one of said blocks between said top flange and said bottom flange thereof and said pair of legs for: fastening said pair of blocks together, securing said bracket to said pair of blocks, and clamping said bottom flanges against opposite sides of a standing seam of a metal roof.

4. The roof anchor according to claim 3 further comprising a pair of alignment pins positioned away from each other and said fastener, each of said alignment pins having opposed ends extending through said notches and penetrating said pair of blocks above said bottom flanges thereof.

5. A roof anchor, comprising:

a pair of blocks positioned side-by-side, each of said blocks having an inner surface defined by a top flange and a bottom flange separated by a triangular notch for receiving a standing seam of a metal roof, each of said blocks also having an outer surface;

a bracket including:

a base portion having a pair of legs, each positioned adjacent said outer surface of each of said blocks, and a crosspiece joining said legs; and, a loop portion affixed to said crosspiece for securement of a safety lanyard;

a plurality of threaded fasteners penetrating each one of said blocks above said bottom flange thereof for fastening said pair of blocks together and clamping said bottom flanges against opposite sides of a standing seam of a metal roof, and one of said threaded fasteners penetrating said pair of legs for securing said bracket to said pair of blocks; and, a pair of alignment pins positioned away from each other and said threaded fasteners, each of said alignment pins having opposed ends extending through said notches and penetrating said pair of blocks above said bottom flanges thereof.

* * * * *